US005682003A

United States Patent [19]

Jarowsky

[11] Patent Number: 5,682,003

[45] Date of Patent: Oct. 28, 1997

[54] SEMI-ACOUSTIC ELECTRIC GUITAR

[76] Inventor: William P. Jarowsky, 1018 Madison St., Waukesha, Wis. 53188

[21] Appl. No.: 534,324

[22] Filed: Sep. 27, 1995

[51] Int. Cl.[6] ..... G10D 3/00

[52] U.S. Cl. ..... 84/267; 84/291; D17/14

[58] Field of Search ..... 84/267, 291, 293, 84/294; D17/14, 19

[56] References Cited

U.S. PATENT DOCUMENTS

| | | | |
|---|---|---|---|
| D. 203,481 | 1/1966 | Wiggins | D56/1 |
| D. 223,290 | 4/1972 | Wolfe | D56/1 |
| D. 267,329 | 12/1982 | Cooper | D17/14 |
| D. 338,221 | 8/1993 | Beliger | D17/14 |
| 2,953,052 | 9/1960 | Newton | 84/291 |
| 2,972,923 | 2/1961 | Fender . | |
| 3,072,007 | 1/1963 | Burke | 84/291 |
| 4,359,923 | 11/1982 | Brunet | 84/291 |
| 4,539,866 | 9/1985 | Hoffart | 84/267 |
| 5,052,269 | 10/1991 | Young | 84/728 |

*Primary Examiner*—Cassandra C. Spyrou
*Attorney, Agent, or Firm*—Donald J. Ersler

[57] ABSTRACT

A semi-acoustic electric guitar comprises a left body member, a center body member, and a right body member, a left megaphone port is formed in the left body member, a center acoustic chamber is formed at a first end of the center body member, a right acoustic chamber is formed in the right body member at a first end, a right megaphone port is formed in the right body member, the left and right body members are joined to the center body member, the left and right megaphone ports communicate with the center acoustic chamber such that sound generated inside the center acoustic chamber is amplified by the right and left megaphone ports. A bridge is fastened to the left and right body members, two electric pickups are fastened to the center body member, a neck is formed at a second end of the center body member, a tone control hole, a volume control hole, and a pickup switch hole are sized to receive a tone control, volume control and pickup switch respectively.

14 Claims, 3 Drawing Sheets

SEMI-ACOUSTIC ELECTRIC GUITAR

BACKGROUND OF THE INVENTION

1. Cross-References to Related Applications

A design patent, Ser. No. 29/042998 was filed on Aug. 22, 1995 for the aesthetic aspects of the disclosed guitar.

2. Field of the Invention

The present invention relates generally to electric guitars and more specifically to a semi-acoustic electric guitar which is designed to produce the sound of a prior art semi-acoustic electric guitar, but being constructed with a smaller acoustic chamber which enables the size of the guitar body to be reduced.

3. Discussion of the Prior Art

For many years the size and shape of the semi-acoustic electric guitar has been dictated by the same construction style, namely a bottom plate, top plate and a wrap around side. The top and bottom edges of the wrap around side are attached to the top and bottom plates to define an acoustic box or chamber with an acoustic port formed in the top plate. This design is not much different than a folk guitar or fully acoustic guitar. An example of a semi-acoustic electric guitar is a Gibson 335. The thickness of the acoustic chamber is the only real difference between an acoustic guitar and a semi-acoustic electric guitar. The semi-acoustic chamber is still large and dictates an outer body which is large and difficult to hold.

The prior art in semi-acoustic electric guitars is very limited. There are a couple of notable improvements or modifications to semi-acoustic guitars over the years. One improvement concerns the mounting of electric pickups as shown in U.S. Pat. No. 5,052,269. The second improvement is a modification of the acoustic chamber as shown in U.S. Pat. No. 4,539,886.

Accordingly, there is a clearly felt need in the art for a semi-acoustic electric guitar that has a smaller body size and yet produces the same semi-acoustic sound found in a larger prior art semi-acoustic electric guitar.

SUMMARY OF THE INVENTION

The primary objective of the present invention is to provide a semi-acoustic electric guitar that has a reduced size yet delivers the same sound that a larger acoustic chamber would produce. With the smaller acoustic chamber, the present invention allows greater design flexibility for guitar body shapes. According to the present invention, a semi-acoustic electric guitar includes a left body member, a center body member and a right body member. A left megaphone port is formed in the left body member at a top surface in substantially the center thereof. A center acoustic chamber is formed in the center body member at a first end thereof. A right acoustic chamber is formed in the right body member at a first end thereof. A right megaphone port is formed in the right body member at a top surface thereof.

The left body member and right body member are connected to the center body member to form a guitar body. The left megaphone port communicates with the center acoustic chamber, wherein sound generated inside the center acoustic chamber flows through the left megaphone port and is amplified thereby. The right megaphone port communicates with the center acoustic chamber, wherein sound generated inside the center acoustic chamber flows through the right megaphone port and is amplified thereby. The right acoustic chamber communicates with the center acoustic chamber, wherein sound generated inside the center acoustic chamber flows to the right acoustic chamber.

A bottom cover attaches to a bottom cover opening in the right body member at the first end thereof. A bridge is fastened to the top surfaces of the left and right body members. A bass electric pickup and a treble electric pickup are fastened to the center body member with an electric pickup spacer separating the bass and treble electric pickups. A neck is formed at a second end of the center body member. A tone control hole, a volume control hole, and a pickup switch hole are sized to receive a tone control, volume control and pickup switch respectively.

Accordingly, it is an object of the present invention to provide a semi-acoustic electric guitar which has a body that is smaller in size than a prior art semi-acoustic electric guitar yet sounds like a prior art semi-acoustic electric guitar.

It is further an object of the present invention to provide a semi-acoustic electric guitar with a smaller acoustic chamber that allows the flexibility to sculpture the guitar body into a myriad of different shapes.

Finally, it is another object of the present invention to provide a semi-acoustic electric guitar that is more comfortable to play because of a reduced guitar body size.

These and additional objects, advantages, features and benefits of the present invention will become apparent from the following specification.

DETAILED DESCRIPTION OF THE PRESENT INVENTION

Figure 1:
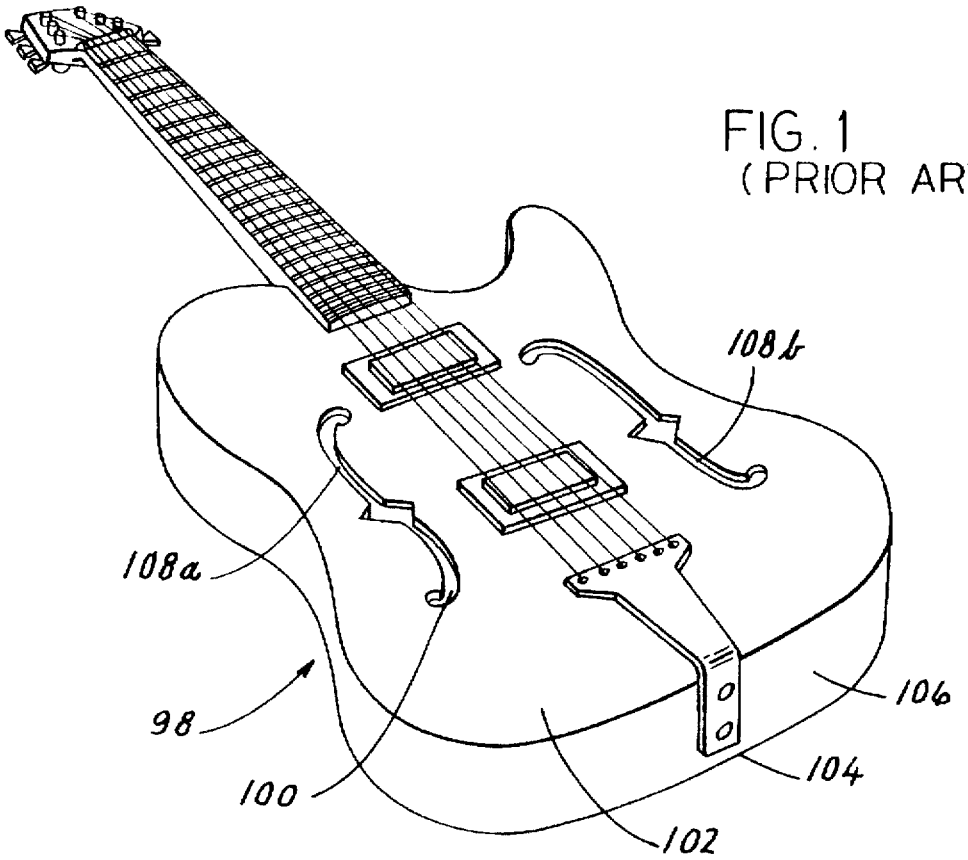
FIG. 1 (PRIOR ART)
FIG. 1 is a perspective view of a prior art semi-acoustic electric guitar.

With reference now to the drawings, and particularly to FIG. 1, there is shown a perspective view of a prior art semi-acoustic electric guitar 98. An acoustic chamber 100 is defined by the area inside a top plate 102, a bottom plate 104 and a wrap around side 106. An acoustic port **108*a* and an acoustic port 108*b* are formed in top plate 102. The acoustic chamber 100** is large and the outside body variations are limited.

Figure 2:
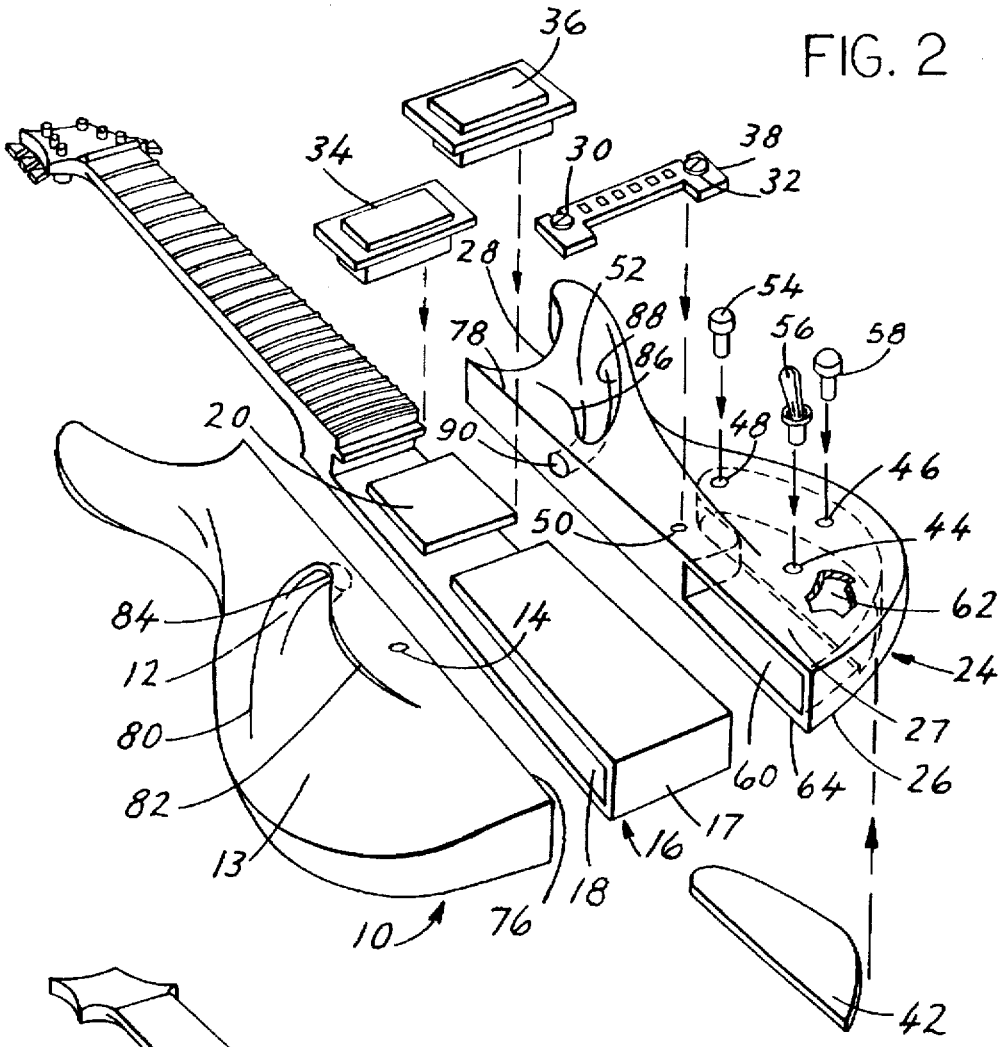
FIG. 2 is an exploded perspective view of a semi-acoustic electric guitar in accordance with the present invention.
Figure 3:
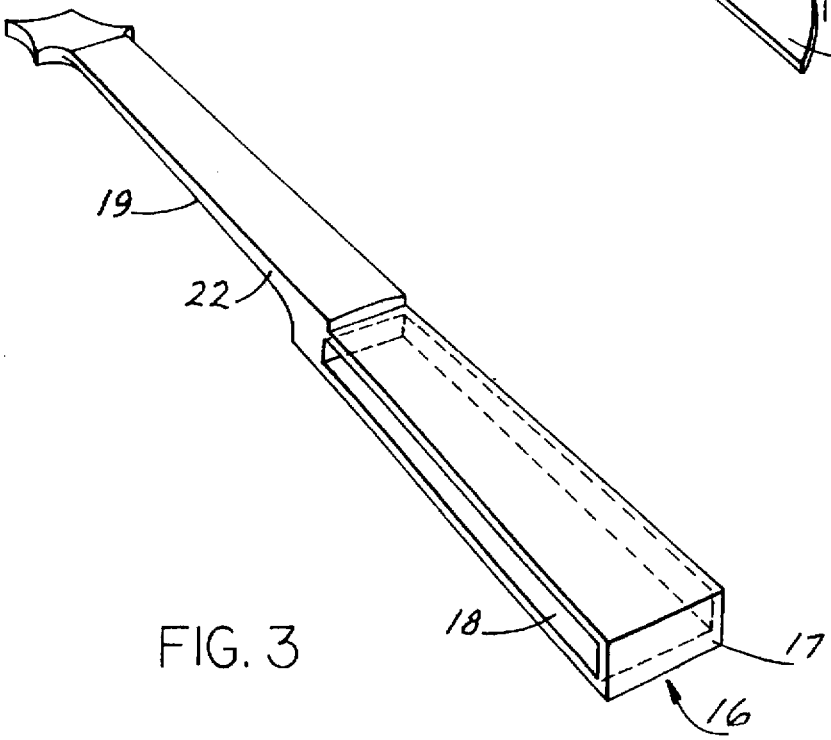
FIG. 3 is a perspective view of a center body member in accordance with the present invention.

FIG. 2 shows an exploded perspective view of a semi-acoustic electric guitar 1 in accordance with the present invention. The semi-acoustic electric guitar 1 comprises a left body member 10, a center body member 16 and a right body member 24. With reference to FIG. 3, a center acoustic chamber 18 is formed in the center body member 16 at a first end 17. A neck 22 is formed at a second end 19 of the center body member 16.

Figure 4:
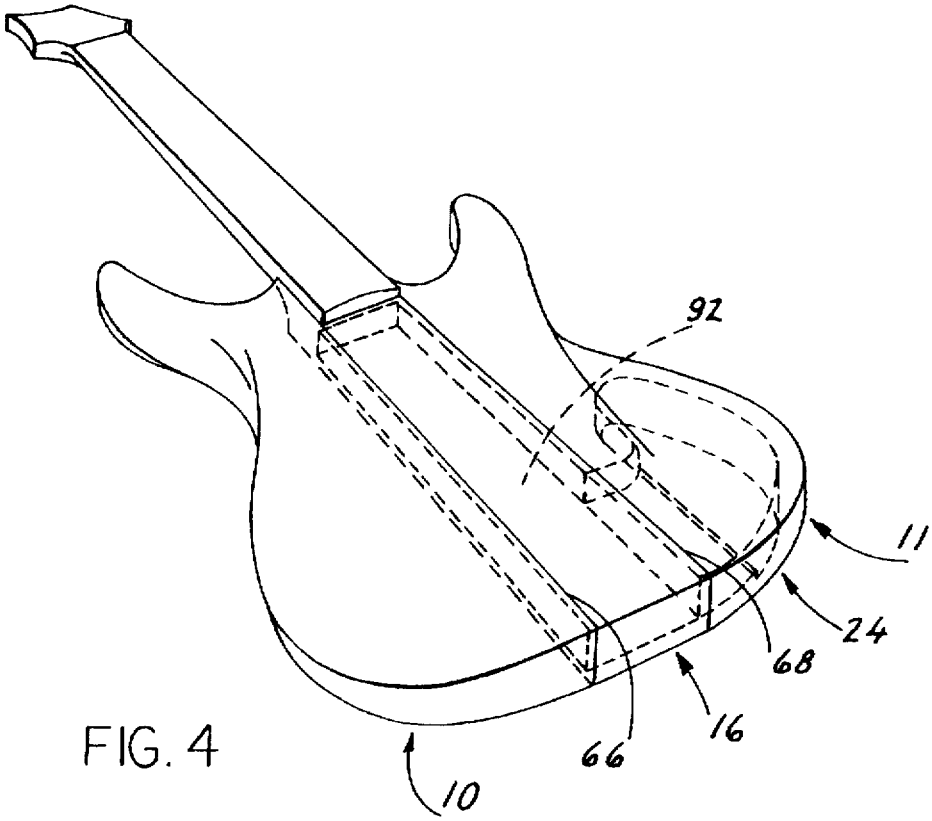
FIG. 4 is a perspective view of an assembled guitar body in accordance with the present invention.
Figure 5:
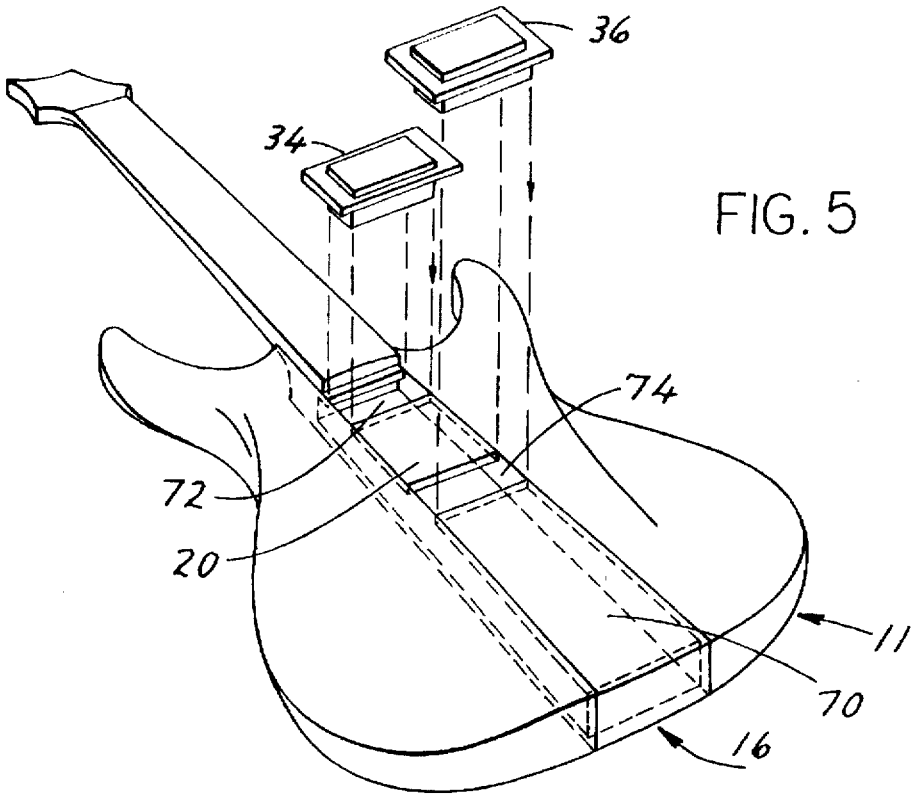
FIG. 5 is a perspective view of an assembled guitar body with cutouts for a bass electric pickup and a treble electric pickup in accordance with the present invention.

A right acoustic chamber 60 is formed in the right body member 24 at a first end 26. Material is removed from a back side 64 of right body member 24 to form a bottom cover opening 62. With reference to FIG. 4, a guitar body 11 is assembled by attaching the left body member 10 to a left edge 66 of the center body member 16 and by attaching the right body member 24 to a right edge 68 of the center body member 16. With reference to FIG. 5, a bass electric pickup cutout 72 and a treble electric pickup cutout 74 are formed in a top surface 70 of the center body member 16. The bass electric pickup cutout 72 and the treble electric pickup cutout 74 are size to receive a bass electric pickup 34 and a treble electric pickup 36, respectively. As a result of the bass electric pickup cutout 72 and the treble electric pickup cutout 74, an electric pickup spacer 20 is formed.

A left megaphone port 12 comprises a tunnel 84, a first wall 80 and a second wall 82. The tunnel 84 originates at a right edge 76 of the left body member 10 and arckedly joins a first wall 80 and a second wall 82. The left megaphone port 12 is formed when the first wall 80 arckedly sweeps away from the second wall 82. The second wall 82 also arckedly sweeps away from the first wall 80. The first wall 80 and the second wall 82 terminate by blending into the top surface 13 of the left body member.

A right megaphone port 52 comprises a tunnel 90, a first wall 88 and a second wall 86. The tunnel 90 originates at a left edge 78 at a second end 28 of the right body member 24 and arckedly joins the first wall 88 and a second wall 86. The right megaphone port 52 is formed when the first wall 88 arckedly sweeps away from the second wall 86. The second wall 86 also arckedly sweeps away from the first wall 88. The first wall 88 and the second wall 86 terminate by blending into the top surface 13 of the left body member 10. A bottom cover 42 seals a bottom cover opening 62 in the right body member 24 to produce a right acoustic chamber 60.

With reference to FIG. 4, when the left body member 10, the center body member 16 and the right body member 24 are assembled, an acoustic chamber 92 is formed which includes the center acoustic chamber 18 and the right acoustic chamber 60. The left megaphone port 12 and the right megaphone port 52 provide the only acoustic venting to the acoustic chamber 92. Sound generated inside acoustic chamber 92 flows out through the left megaphone port 12 and the right megaphone port 52 and is amplified thereby. The left megaphone port 12 and the right megaphone port 52 act as sound amplifiers as does a cone megaphone for amplifying a voice. Thus, the sound generated inside the smaller acoustic chamber found in the semi-acoustic electric guitar 1 can produce the sound generated inside the larger acoustic chamber found in the prior art semi-coustic guitar 98 shown in FIG. 1.

A threaded left bridge hole 14 is formed in the top surface 13 of left body member 10, a threaded right bridge hole 50 is formed in the top surface 27 of right body member 24, the threaded left bridge hole 14 and the threaded right bridge hole 50 are sized to receive the left bridge screw 30 and the right bridge screw 32, respectively. The left bridge screw 30 and the right bridge screw 32 retain bridge 38 against semi-acoustic electric guitar 1.

A tone control hole 46, a volume control hole 48 and a pickup switch hole 44 are formed in the top surface 27 of the right body member 24. The tone control hole 46, the volume control hole 48, and the pickup switch hole 44 are sized to receive a tone control 54, a volume control 58 and an electric pickup switch 56. The bottom cover opening 62 provides access to the tone control 54, the volume control 58, and the electric pickup switch from the back side 64.

Figure 6:
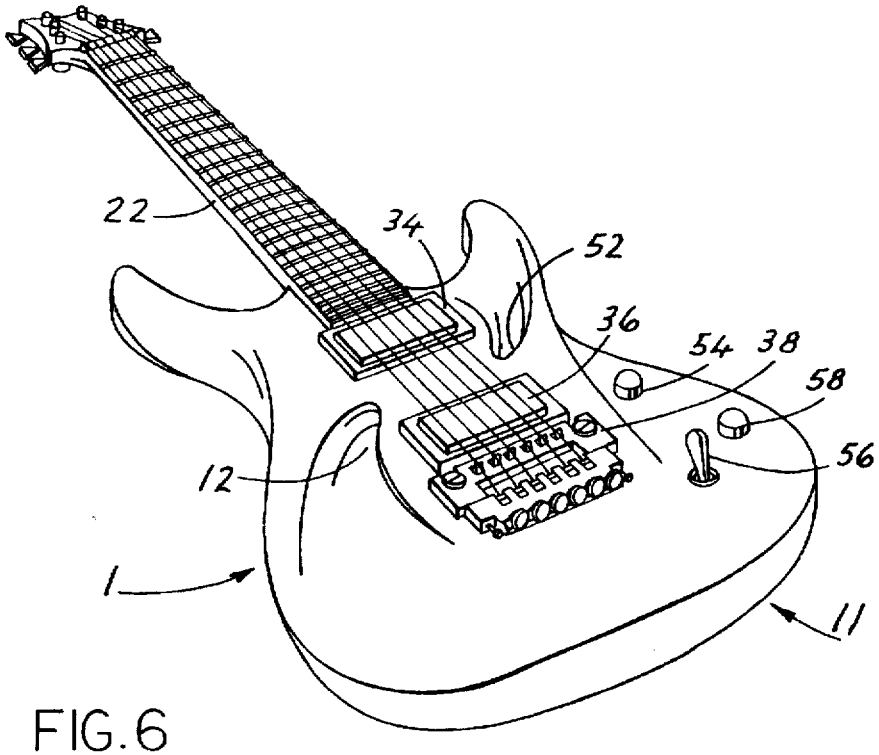
FIG. 6 is perspective view of the semi-acoustic electric guitar in accordance with the present invention.

FIG. 6 shows a perspective view of the semi-acoustic electric guitar 1 after assembly. The guitar body 11, neck 22, left megaphone port 12, right megaphone port 52, bass electric pickup 34, treble electric pickup 36, bridge 38, volume control 54, tone control 58 and pickup switch 56 are shown. The semi-acoustic electric guitar 1 has a stratocaster body style. Nearly any solid body electric guitar style can used in conjunction with the present invention and yet produce the same semi-acoustic electric sound found in the prior art semi-acoustic electric guitar.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A semi-acoustic electric guitar comprising:

a guitar body;

an acoustic chamber located inside said guitar body; and at least one megaphone port having a tunnel, a first wall, and a second wall, an end of said tunnel communicating with said acoustic chamber, an opposite end of said tunnel being joined to said first wall and said second wall, said first wall sweeping away from said second wall, wherein sound generated inside said acoustic chamber is amplified by said at least one megaphone port.

2. The semi-acoustic electric guitar of claim 1 further comprising:

a top surface located on said guitar body, said first wall and said second wall terminating at said top surface of said guitar body.

3. The semi-acoustic guitar of claim 1 further comprising:

said acoustic chamber formed by joining a center acoustic chamber to a right acoustic chamber;

a left body member having a top surface;

a center body member having a first end, a second end, a left edge, a right edge and said center acoustic chamber formed at said first end;

a neck which is formed at said second end of said center body member;

a right body member having a first end, a top surface, a back side, wherein said right acoustic chamber is formed at said first end of said right body member, material is removed at said back side at said first end of said right body member to form a bottom cover opening; and wherein said left body member is attached to said left edge of said center body member and said right body member is attached to said right edge of said center body member, said right acoustic chamber in said right body member communicates with said center acoustic chamber in said center body member, wherein sound generated in said center acoustic chamber of said center body member flows into said right acoustic chamber in said right body member.

4. The semi-acoustic electric guitar of claim 3 further comprising:

said at least one megaphone port including a left megaphone port, and a right megaphone port; and wherein said left megaphone port communicates with said center acoustic chamber in said center body member and terminates at said top surface of said left body member, said right megaphone port communicates with said center acoustic chamber in said center body member and terminates at said top surface of said right body member.

5. The semi acoustic electric guitar of claim 4 further comprising:

a bottom cover which fits into said bottom cover opening of said right body member;

a bridge which is fastened to said top surface of said guitar body;

a bass electric pickup, a bass electric pickup cutout is formed in said center body member, said bass electric pickup being fastened to said center body member;

a treble electric pickup, a treble electric pickup cutout is formed in said center body member, said treble electric pickup being fastened to said center body member;

a tone control, a tone control hole formed in said right body member, said tone control hole sized to receive said tone control;

a volume control, a volume control hole formed in said right body member, said volume control hole sized to receive said volume control;

a pick up switch, a pick up switch hole formed in said right body member, said pick up switch hole sized to receive said pick up switch; and wherein said bottom cover opening providing access to the back of said tone control, volume control and said pick up switch.

6. The semi acoustic electric guitar of claim 1, wherein;

said first wall being a curved plane; and said second wall being a curved plane.

7. A semi-acoustic electric guitar comprising:

a guitar body having a top surface;

an acoustic chamber located inside said guitar body; and at least one megaphone port being formed in said top surface of said guitar body, said at least one megaphone port having a tunnel, a first wall, and a second wall, an end of said tunnel communicating with said acoustic chamber, an opposite end of said tunnel being joined to said first wall and said second wall, said first wall sweeping away from said second wall, wherein sound generated inside said acoustic chamber is amplified by said at least one megaphone port.

8. The semi-acoustic electric guitar of claim 7 further comprising:

said first wall and said second wall terminating at said top surface of said guitar body.

9. The semi-acoustic guitar of claim 6 further comprising:

said acoustic chamber formed by joining a center acoustic chamber to a right acoustic chamber;

a left body member having a top surface;

a center body member having a first end, a second end, a left edge, a right edge, and material removed to form said center acoustic chamber at said first end;

a neck which is formed at said second end of said center body member;

a right body member having a first end, a top surface, a back side, wherein, said right acoustic chamber is formed at said first end of said right body member, and material is removed at said back side at said first end of said right body member to form a bottom cover opening; and wherein said left body member is attached to said left edge of said center body member and said right body member is attached to said right edge of said center body member, said right acoustic chamber in said right body member communicates with said center acoustic chamber in said center body member, wherein sound generated in said center acoustic chamber of said center body member flows into said right acoustic chamber in said right body member.

10. The semi-acoustic electric guitar of claim 9 further comprising:

said at least one megaphone port including a left megaphone port, and a right megaphone port; and wherein said left megaphone port communicates with said center acoustic chamber in said center body member and terminates at said top surface of said left body member, said right megaphone port communicates with said center acoustic chamber in said center body member and terminates at said top surface of said right body member.

11. The semi acoustic electric guitar of claim 10 further comprising:

a bottom cover which fits into said bottom cover opening of said right body member;

a bridge which is fastened to said top surface of said guitar body;

a bass electric pickup, a bass electric pickup cutout is formed in said center body member, said bass electric pickup being fastened to said center body member;

a treble electric pickup, a treble electric pickup cutout is formed in said center body member, said treble electric pickup being fastened to said center body member;

a tone control, a tone control hole formed in said right body member, said tone control hole sized to receive said tone control;

a volume control, a volume control hole formed in said right body member, said volume control hole sized to receive said volume control;

a pick up switch, a pick up switch hole formed in said right body member, said pick up switch hole sized to receive said pick up switch; and wherein said bottom cover opening providing access to the back of said tone control, volume control and said pick up switch.

12. The semi acoustic electric guitar of claim 7, wherein:

said first wall being a curved plane; and said second wall being a curved plane.

13. At least one megaphone port for amplifying the sound of a musical instrument having an acoustic chamber comprising:

at least one said megaphone port having a tunnel, a first wall, and a second wall, an end of said tunnel communicating with said acoustic chamber, an opposite end of said tunnel being joined to said first wall and said second wall, said first wall sweeping away from said second wall, wherein sound generated in said acoustic chamber is amplified by at least one said megaphone port.

14. Said at least one megaphone port for amplifying the sound of a musical instrument having an acoustic chamber of claim 11, wherein:

said first wall being a curved plane; and said second wall being a curved plane.

* * * * *